United States Patent [19]

Cox et al.

[11] 4,044,507

[45] Aug. 30, 1977

[54] METHOD AND APPARATUS FOR STRIPPING, CLEANING AND TREATING SURFACES

[75] Inventors: Fred L. Cox, Alexandria, Va.; Steve Crump; Phate Hice, both of Morganton, N.C.

[73] Assignee: Silver Creek Minerals Corporation, Morganton, N.C.

[21] Appl. No.: 685,679

[22] Filed: May 12, 1976

[51] Int. Cl.[2] ..... B24C 1/00; B24C 9/00

[52] U.S. Cl. ..... 51/424; 51/427; 51/319; 51/321; 51/308

[58] Field of Search ..... 51/8 HD, 8 BR, 308, 51/319, 321

[56] References Cited

U.S. PATENT DOCUMENTS

| | | | |
|---|---|---|---|
| 2,625,514 | 1/1953 | Kirschenbauer | 51/308 X |
| 2,744,001 | 5/1956 | Harman | 51/308 |
| 2,876,601 | 3/1959 | McFaddan | 51/8 HD X |
| 3,097,451 | 7/1963 | Freeman | 51/319 X |
| 3,553,895 | 1/1971 | Power | 51/8 BR |

*Primary Examiner*—Gary L. Smith
*Attorney, Agent, or Firm*—John E. Benoit

[57] ABSTRACT

A method and apparatus for supplying a source of olivine grit material, providing a source of fluid pressure, mixing the ingredients in a sandblasting type of gun, and directing the mixture directly against the surface to be treated. The gun may be adapted so as to provide various spray patterns as desired. The fluid pressure may be either a liquid or a gas.

11 Claims, 2 Drawing Figures

METHOD AND APPARATUS FOR STRIPPING, CLEANING AND TREATING SURFACES

BACKGROUND OF THE INVENTION

This invention relates generally to treatment of surfaces of various materials and more specifically to the stripping, cleaning and treating of various materials through the use of abrasive grit driven against the surface by fluid pressure.

Generally speaking, treatment of the surface of various materials is accomplished either through the use of mechanical smoothing techniques such as sanding or through the use of chemicals designed to strip or clean the surfaces.

An example of chemical treatment occurs in the refinishing of furniture wherein chemical solutions are used to remove the existing finish. Major problems are inherent with the use of chemicals for such purposes. They are often dangerous or irritative, and care must be used by the operators in order to avoid injury as a result of physical contact with the chemicals. Additionally, almost all chemicals give off fumes which, in some cases, can be dangerous if inhaled or if the eyes are exposed.

A further problem which arises when chemicals are used is that of disposal. Present environment requirements prevent the discharge of waste material in the ground or streams. Accordingly, the disposal of such waste material requires expenditure of considerable time and substantial additional expense.

Abrasive treatment of materials such as wood and metal has been accomplished through laborious hand treatment or by the use of some type of mechanical equipment. Such treatment may be used either on wood or metal and, in either case, is quite time consuming. Additionally, it is nearly impossible to strip all of the surface material if any designs exists therein which create indentations and corners.

Sandblasting has been used for certain specific instances of treating wood surfaces. Specifically, this technique has been used to remove the softer pulp material while leaving the grain of the wood standing in relief to create a certain surface texture. To our knowledge, sandblasting has never been successfully used to obtain a relatively smooth clean surface.

Sandblasting has been used for removing the finish from metals in order to prepare them for repainting or the like. Such techniques tend to pit and scratch the metal surface to such an extent that it results in an unsatisfactory finished product.

The above discussion relating to woods and metals are illustrative only since surfaces of fabric, fiberglass, glass, vinyl, rubber, etc., may also be treated using the present invention to obtain desired surface conditions.

For the above reasons as well as others that will become apparent, it will be obvious that an inexpensive, safe and relatively fast method for stripping, cleaning and treating surfaces would be highly desireable.

SUMMARY OF THE INVENTION

Accordingly, it is an object of the present invention to provide a method and apparatus for treating a surface so as to obtain a clean surface.

A further object of the present invention is to provide a method and apparatus for stripping and cleaning surfaces quickly and safely so that they may be refinished without further preparation.

Another object of the invention is to provide a method and associated apparatus for stripping, cleaning and treating surfaces through the use of an abrasive material consisting of olivine grit driven against said surfaces by fluid pressure.

Broadly speaking, the present invention relates to a method and apparatus for supplying a source of olivine grit material, providing a source of fluid pressure, mixing the ingredients in a sandblasting type of gun, and directing a stream the mixture directly against the surface to be treated. The gun may be adapted so as to provide various spray patterns as desired. The fluid pressure may be either a liquid or a gas.

DETAILED DESCRIPTION OF THE INVENTION

Figure 1:
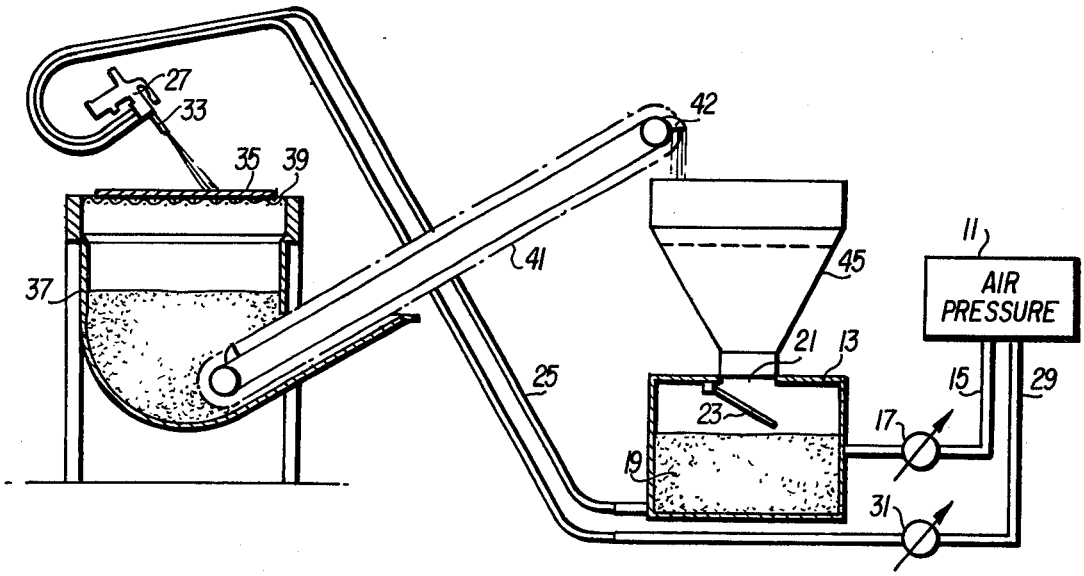
FIG. 1 is a schematic view of one embodiment of the apparatus.

Referring now to FIG. 1, air pressure 11 may be supplied by any well known means such as a compressor. This pressure is supplied to a container 13 through line 15 and valve 17. Container 13 contains the olivine grit material 19 and includes an opening 21 which may be sealed by means of a door 23. When door 23 is sealed and pressure is applied to container 13 through line 15, the olivine material is forced under pressure through line 25 to blasting gun 27. Such guns are commercially available from various sources, such as Empire Abrasive Equipment Corporation.

Air pressure is also supplied directly to gun 27 by means of line 29 and valve 31. Air pressure and olivine grit material are mixed in gun 27 and directed outwardly through nozzle 33 against the surface of the material 35 to be treated.

A reclaim pan 37 is positioned below the working area, and a supporting screen 39 may be placed between the work area and pan 37. A conveyor 41 having buckets 42 extends into the reclaim pan and may be driven by a motor (not shown). After the olivine material strikes the surface, it drops into pan 37 where the buckets 43 of conveyor 41 scoop it up. The reclaimed material is deposited into a hopper 45 mounted above door 23. When the material in the hopper 45 is to be used to replenish the material in container 13, the pressure in line 15 is reduced and door 23 is opened. Prior to resuming operation, the door is closed and pressure in line 15 is raised to the desired level.

Figure 2:
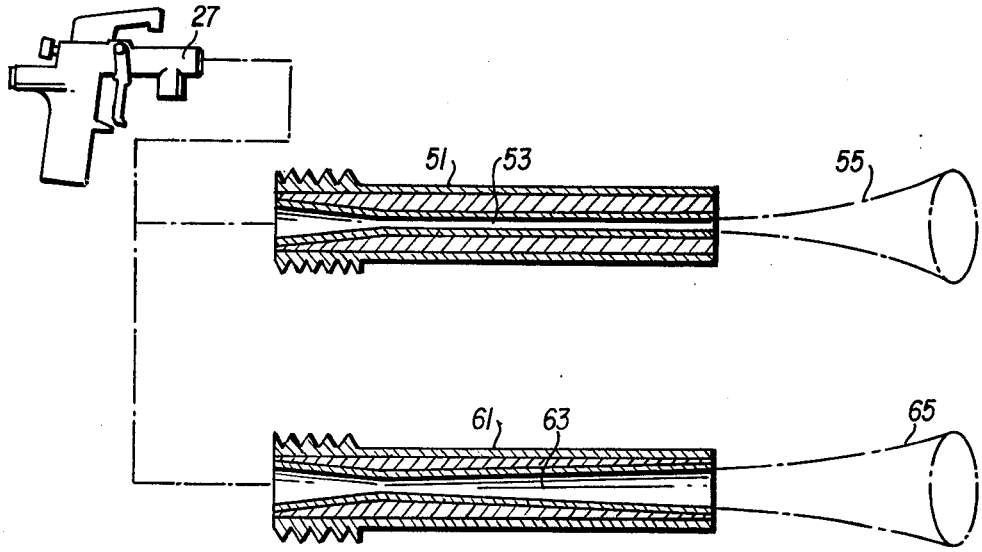
FIG. 2 is a sectional view of the nozzle means according to this invention.

Turning now to FIG. 2, there is shown one means for varying the spray pattern from nozzle 33. There are shown therein two nozzles 51 and 61 with different orifices 53 and 63 respectively. Nozzle 51 having straight orifice 53 concentrates the olivine abrasive in the center of the blasting pattern, as shown at 55, with a small amount in the outer edges. Nozzle 61 having venturi orifice 63 distributes the olivine abrasive substantially evenly over the pattern 65 shown. These nozzles are commercially available from the above-mentioned source.

When using the above or equivalent apparatus with olivine grit material the process does not produce the damaging pits, mars or scratches on the surface being treated as normally occurs during sandblasting due to the nature of the olivine crystal structure.

Olivine, also known as chrysolite or peridot, is the most common member of a group of silicates. Olivine is a magnesium-iron silicate, colored various shades of green (occasionally brown) with a hardness of 6.5 to 7 based on a diamond hardness scale of 10, and a specific gravity of 3.3. It is found in igneous rocks that are rich in magnesium and low in quartz. It is found both in small grains and in large, granular masses. The chemical composition of olivine is $(MgFe)_2SiO_4$.

Olivine is mined, treated and bagged by grit size. Supplies of olivine are readily available in quantities needed for this process since it is also used for metal casting purposes. The mesh size preferably used in the present invention may vary from 40 to 400 grit (the higher the number the smaller the grain). Smaller grains are used to polish surfaces previously stripped or cleaned by larger sized grains.

The specific technique of application and the results obtained from the use of olivine against the material being treated varies with the type of material, i.e. softwood, veneer, hardwood, metal, fabric, fiberglass, glass, vinyl, rubber, etc.

Air pressure may vary from 20 to substantially 300 psi, depending upon the particular application. As illustrated in FIG. 1, air pressure is controlled by means of the variable valves, both to the olivine container and to the gun. When the trigger of the gun is activated, the air and olivine are combined under predetermined pressure and the olivine is directed against the surface of the material in a spray pattern.

For certain applications, it may be desirable to use a liquid fluid instead of a gaseous fluid. Equipment is available for this purpose and may be used in the system shown in FIG. 1.

The versatility of the present invention is illustrated by its applicability to the various materials discussed above. Surface markings and prints can be removed from fabric without harm to the material itself. This is also true of softer materials such as rubber and various types of plastics. When used with glass, a fine frosted end product may be produced. When used for cleaning metals, a very finely roughened finish is produced. This finish still feels relatively smooth, but it improves the ability of the metal to accept and retain finishes such as paint. When used for removing finishes from wood, the surface may be cleaned so as to present the material substantially as it was in its pretreated condition. None of the above results are obtainable when using other abrasive materials such as sand.

One remarkable aspect of the present device is the safety which is inherent in the system. All operating instructions which accompany sand blast equipment warn against the exposure of the hands or skin directly in the line of the blast nozzle. In the present invention as used within the pressure parameters of 20 to 60 psi, the material may be held in an unprotected hand while the surface is being cleaned and stripped, since the olivine striking the hand causes no damage or significant irritation. The advantages of such a fact are obvious since this is not possible when using sand blasting equipment.

As discussed above, the present method and apparatus eliminates the problems inherent with the use of chemical systems. Olivine is a natural mineral and is non-poisonous. Further, after a period of use the olivine grit may be cleaned, such as by heating in a furnace, and reused.

The above description and drawings are illustrative only since equivalent devices could be used within the scope of the invention. Accordingly, such scope is to be limited only by the following claims.

We claim:

1. A method for treating a surface of a material which comprises directing a stream of olivine grit material against said surface under a predetermined pressure.

2. The method of claim 1 which further comprises mixing said grit with a fluid under said predetermined pressure prior to directing said material against said surface.

3. The method of claim 2 wherein said predetermined air pressure is at least 20 psi.

4. The method of claim 1 wherein said grit size is between 40 and 400 grit.

5. The method of claim 1 which further comprises recovering said grit material after it has been directed against said surface; and redirecting said recovered material against said surface.

6. A method for treating a surface of a material which comprises providing a source of olivine grit material;

providing a source of fluid under pressure;

combining said fluid and said olivine grit material; and directing said mixture of fluid and grit material against said surface.

7. The method of claim 6 which further comprises recovering said grit material after it has been directed against said surface; and returning said recovered grit material to said source of olivine grit material.

8. A system for stripping, cleaning and treating a surface of a material comprising a source of olivine grit material;

a source of fluid pressure, means for combining said fluid pressure and said grit material in a spraying apparatus, means in said spraying apparatus for directing said grit material against said surface.

9. The system of claim 8 wherein said fluid pressure is at least 20 psi.

10. The system of claim 8 wherein said grit material size is between 40 and 400 grit.

11. The system of claim 8 further comprising means for recovering said used grit material; and means for returning said used grit material to said source.

* * * * *